US005213863A

United States Patent [19]

Day et al.

[11] Patent Number: 5,213,863

[45] Date of Patent: May 25, 1993

[54] FABRIC AND STRUCTURE

[75] Inventors: Gerald F. Day, Derbyshire; Giles T. Gregory, Nottinghamshire, both of United Kingdom

[73] Assignee: General Motors Corporation, Detroit, Mich.

[21] Appl. No.: 838,924

[22] Filed: Feb. 21, 1992

[30] Foreign Application Priority Data

Mar. 1, 1991 [GB] United Kingdom ..... 9104381

[51] Int. Cl.[5] ..... B32B 3/00

[52] U.S. Cl. ..... 428/71; 5/481; 66/64; 66/190; 66/196; 66/198; 428/68; 428/76; 428/253

[58] Field of Search ..... 428/68, 71, 76, 253; 66/190, 25, 114, 196, 194, 198, 64, 196; 5/481

[56] References Cited

U.S. PATENT DOCUMENTS

| | | | |
|---|---|---|---|
| 3,808,843 | 5/1974 | Blore et al. | 66/196 |
| 4,062,204 | 12/1977 | Segundo et al. | 66/196 |
| 4,587,811 | 5/1986 | Hiromoto et al. | 66/196 |
| 4,733,546 | 3/1988 | Toda | 66/196 |
| 4,891,958 | 1/1990 | Courmoyer et al. | 66/196 |

FOREIGN PATENT DOCUMENTS

| | | |
|---|---|---|
| 0361855 | 4/1990 | European Pat. Off. . |
| 518709 | 3/1940 | United Kingdom . |
| 1247676 | 9/1971 | United Kingdom . |
| 2206609 | 1/1989 | United Kingdom . |
| 2223034 | 3/1990 | United Kingdom . |
| 2223035 | 3/1990 | United Kingdom . |

*Primary Examiner*—James J. Bell

*Attorney, Agent, or Firm*—Davis Hoxie Faithfull & Hapgood

[57] ABSTRACT

An upholstered structure comprising a three dimensional support core having a fabric cover, and in which the fabric cover is a double jersey knitted structure, the technical reverse side of the fabric cover being located on the core side of the upholstered structure and exhibiting at least one identifying mark in a contrasting yarn to its surroundings, the mark being substantially not visible on the exposed technical face of the fabric.

13 Claims, 2 Drawing Sheets

FABRIC AND STRUCTURE

BACKGROUND OF THE INVENTION

1. Field of the Invention

This invention relates to knitted fabrics and has particular reference to knitted fabrics for incorporation in upholstered three dimensional structures.

2. Description of Related Art

Proposals have been made see European Patent Application 361,855 - to produce knitted fabric structures for incorporation into upholstered structures such as seats, particularly vehicle or automobile seats.

Such knitted structure are produced automatically on twin bed weft knitting machines incorporating a pair of opposed needle beds having independently operable needles in which the needles are selected for knitting by an electronically controlled jacquard system.

The upholstery fabric may be manufactured in one operation automatically.

In some cases however it is desired to attach the upholstery fabric to a vinyl or woven fabric to form a complete seat back or seat base.

It will be appreciated that in such systems the fabric covers are stitched together inside out so that the covers can be placed over a core structure - commonly referred to as a foam bun—by being turned inside out over the structure.

Prior to assembly of a seat structure therefore it is often necessary to work with fabrics where the face of the fabric cannot be seen by the operator.

The technical face of the knitted fabric is the side seen by the eventual user of the upholstered structure. The technical reverse of such a fabric is the other side which is in contact with or adjacent to the core of the upholstered three dimensional structure.

The present invention provides for a method of readily identifying the fabric during those times when it is inside out i.e. when the technical reverse is the only side readily apparent to the operator or assembler of a three dimensional upholstered structure. The present invention further provides means whereby an identification mark may be incorporated into the fabric without ruining the appearance of the technical face of the fabric.

SUMMARY OF THE INVENTION

By the present invention there is provided an upholstered structure comprising a three dimensional support core having a fabric cover, and in which the fabric cover is a double jersey knitted structure wherein the technical reverse side of the fabric cover is located on the core side of the upholstered structure and the technical face side is on the outside of the structure, wherein the technical face side is formed of integral interconnected loops of yarn and the technical reverse side is formed of integral interconnected loops of yarn, the two sides being interconnected over substantial regions of the fabric by yarn loops integrally formed and passing between the technical face and technical reverse wherein on the technical reverse side there is integrally knitted during manufacture of the fabric at least one identifying mark in a contrasting yarn to its surroundings, the mark being substantially not visible on the technical face of the fabric.

The present invention also provides a machine knitted double jersey fabric upholstery cover in which there is provided on the technical reverse of the fabric at least one integrally knitted identifying mark for the fabric knitted in a different colour or shade from its surroundings and being substantially invisible on the technical face of the fabric.

The identifying mark may identify the machine on which the fabric was knitted. The mark may further be dated and/or timed or sequentially indexed to individually identify the cover knitted.

The mark may identify the person knitting the fabric and/or processing the fabric. The mark may identify the application or use of the fabric.

The present invention also provides a method of knitting a double jersey upholstery fabric on a pair of opposed needle beds having individually controlled needles in which the needles are so controlled that an identifying mark for the fabric is knitted on the reverse side of the fabric whilst being substantially invisible on the face of the fabric.

The present invention yet further provides an upholstered fabric structure comprising a core and a covering of a double jersey machine knitted fabric in which there is provided on the inside of the fabric structure and integrally knitted with the fabric an identifying mark knitted into the structure, which mark is substantially invisible to the unskilled eye on the visible face of the fabric.

BRIEF DESCRIPTION OF THE DRAWINGS

By way of example, embodiments of the present invention will now be described with reference to the accompanying drawings, of which

DESCRIPTION OF PREFERRED EMBODIMENTS

Figure 1:
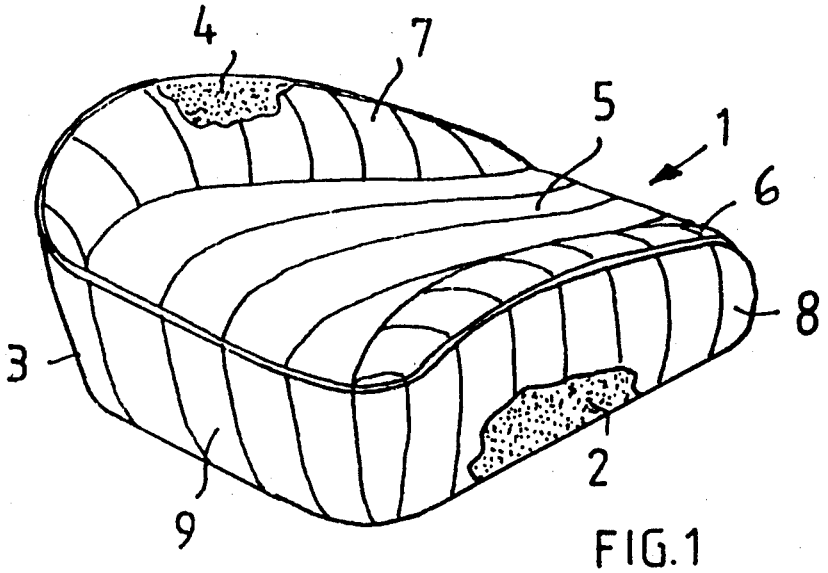
FIG. 1 is a perspective view of a seat base.

Referring to FIG. 1 this shows a seat base generally indicated by 1. The seat base incorporates a foam three dimensional core structure 2. A fabric cover 3 is stretched over the core structure 2. As shown, the core structure 2 may be of any desired shape, for example incorporating wings 4. The body of the fabric stretches over the core producing a base region 5 with side wings 6,7 covering the core structure. The edges of the seat are provided with integrally knitted edge members such as 8,9 which are secured to the base of the seat in a manner known per se.

The fabric cover 3 is a double jersey knitted structure knitted on a flat V-bed knitting machine provided with a loop holding device for holding down the knitted fabric between the opposed needle beds of the machine. Essentially such a double jersey structure comprises a pair of single jersey fabric layers formed of interconnected loops or stitches of yarn wherein the opposing pairs of layers are interconnected by further loops of yarn. It is possible to produce highly complex designs on the fabric structure by automatically controlling the operation of the knitting needles and particularly where two or three colours of yarn are used. Normally such fabrics would be knitted with a jacquard knitting machine in which the colours of the face of the fabric can be determined by suitable needle selection.

Conventionally it is only the technical face of the fabric which has to have the attractive appearance. The technical reverse of the fabric, either being covered with a reinforcing or padding layer or being directly in contact with the core structure of the upholstered product is of no particular interest to the eventual consumer.

It has now been discovered that it is possible to put identifying marks on the technical reverse of the fabric which enable the fabric to be identified without the fabric markings being readily visible on the fabric face. Although it may be possible for an expert in knitting to determine that there is a mark on the fabric face such marks are not readily visible to the untutored eye. It is possible, therefore, to provide a variety of identifying marks on the technical reverse side of the fabric. For example bar codes could be incorporated in the fabric reverse side to enable the fabric readily to be identified by bar code reading machines. Alternatively the knitting machine on which the fabric has been knitted could be identified. In the case of double headed knitting machines - i.e. machines which knit two products at the same time side-by-side, the individual items can be identified as left or right hand.

Because modern electronically controlled jacquard knitting machines can be arranged so that each time a product is knitted, it can be noted, a number can be used positively to identify each individual product knitted. The number can be sequentially indexed. The date and time of knitting may be incorporated.

Instructions to the assembler of the upholstered structure can be incorporated.

The knitting-in of the identification marks can be carried out by conventional techniques. The knitting techniques useful to the invention will be found in the following works of reference.

"Knitting" by H Wignell, Published by Pitman Publishing 1971 Edition, London

"An Introduction to Weft Knitting" by J A Smirfitt, Published by Merrow Technical Library, Watford, England, 1975

"Advanced Knitting Principles" Edited by C Reichman, Published by National Knitted Outerwear Association, New York, N.Y., 1964

"Fully Fashioned Garment Manufacture" by R W Mills, Published by Cassell, London, 1965 and

"Knitting Technology" by D J Spencer, Published by Pergamon Press, London, 1983.

The knitting may be carried out on a flat bed machine such as:

a Stoll CMS Selectanit machine, for details see Knitting International, May 1990, pages 26–28, or a Steiger Electra 120FF machine, for details see Knitting International, April 1990, page 96, or a Shima Seiki SES machine, for details see Knitting International, September 1989, page 60.

In the case of upholstery fabrics for vehicles the upholstery fabrics may be individually tailored to the demands of a customer—the customer's name or even portrait may be knitted into the fabric and this can be positively identified on the reverse side without being readily visible on the fabric face.

Figure 2:
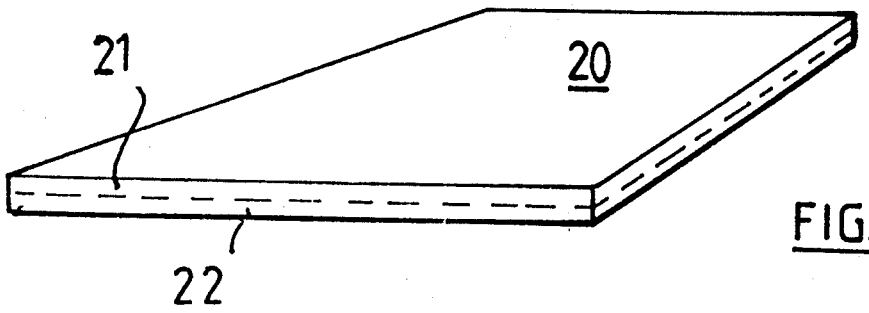
FIG. 2 is a schematic view of a piece of double jersey fabric.

Illustrated in FIG. 2 is a schematic view of a double jersey knitted structure wherein the technical face side 20 effectively comprises a series of loops in a plane 21 formed on one bed of a V-bed knitting machine with the technical reverse side being formed of a series of loops in a layer 22 with the layers being interconnected by a further series of loops.

Figure 3:
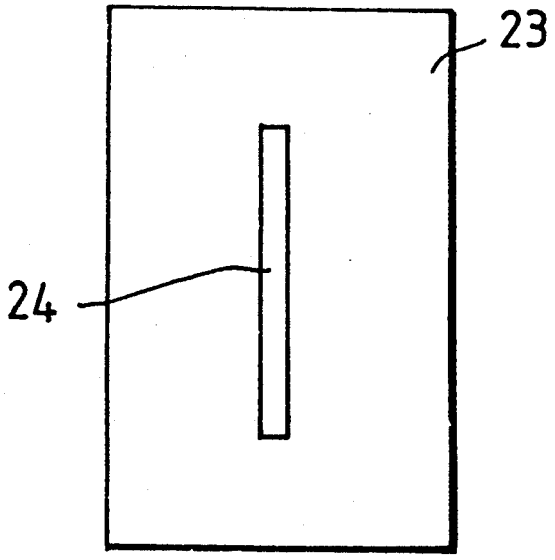
FIG. 3 is a plan view of a fabric reverse side incorporating the numeral 1.
Figure 4:
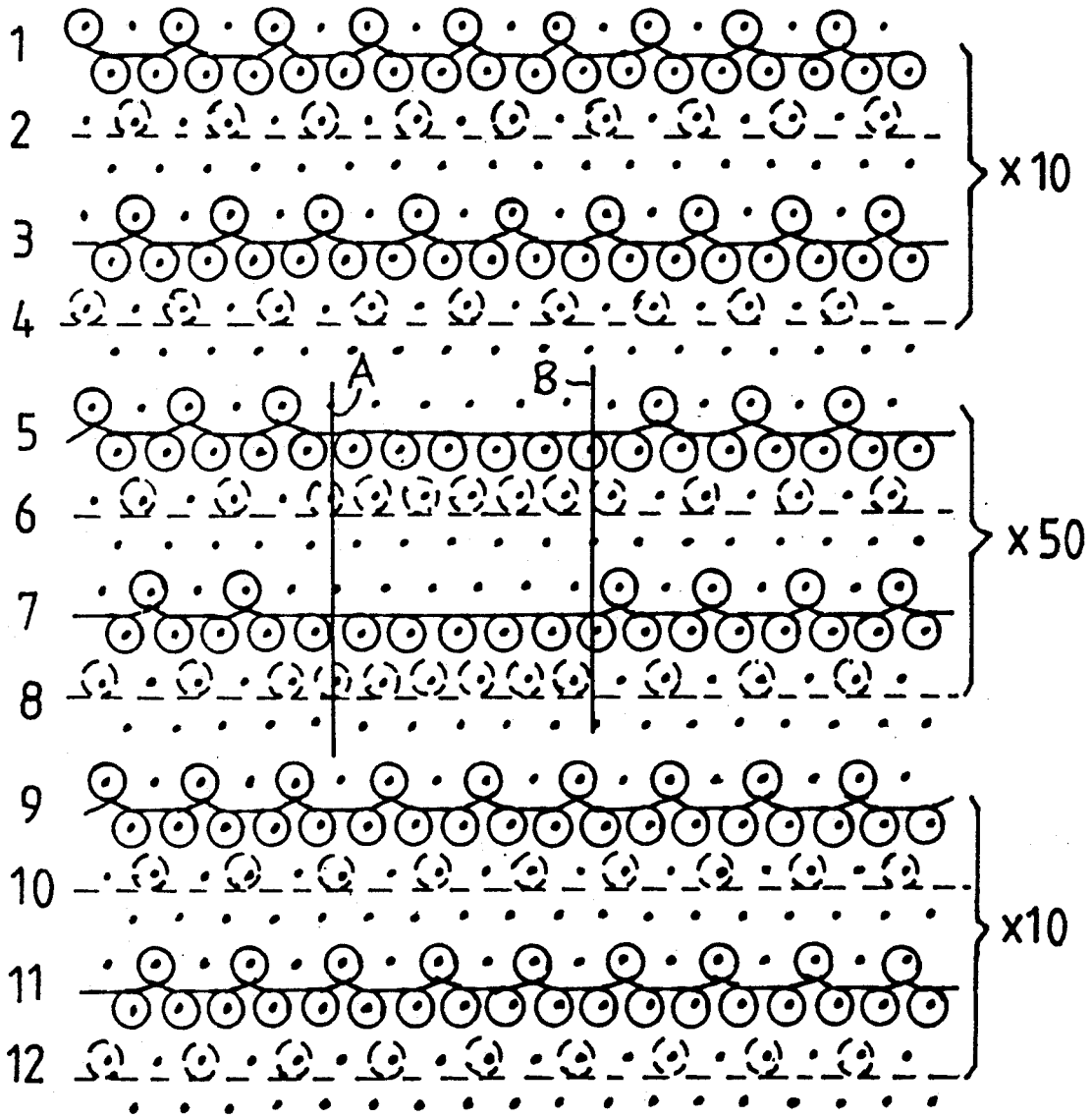
FIG. 4 is a stitch diagram showing the production of the fabric marking illustrated in FIG. 3.

In FIG. 3 there is illustrated a portion of a fabric reverse side 23 in which a mark 24 (the numeral i) has been knitted. FIG. 4 shows the knitting sequence which produces the structure of FIG. 3.

In FIG. 4 there is shown 12 rows or courses of weft knitted structure which form the basis of the fabric shown in FIG. 3. The first four rows are repeated 10 times (referred to as X10 in the drawing), the second set of four rows numbered from 5 to 8 are also repeated, this time 50 times (referred to as X50 in the drawing), the final four courses numbered 9 to 12 are also repeated 10 times (referred to as X10 in the drawing).

Considering first the course numbers 1 to 4, these stitch diagrams effectively represent the needles on the opposed beds and the yarn being knitted on those needles. Thus in course number 1 it can be seen that on the upper needle bed, which is the rear bed in a conventional knitting machine, every alternate needle is knitted upon. In the lower row which corresponds to the front knitting bed every needle is knitted upon. In this particular nomenclature the upper row of needles corresponds to the rear bed and the technical reverse of the fabric. The lower row of needles refers to the front bed on which the technical face of the fabric is produced - i.e. the face seen by the eventual customer.

Because of the way in which yarn passes between the front and rear beds, the two faces of the fabric are interlinked. It can be seen that the front face of the fabric will be comprised entirely of yarn colour number 1 shown as a solid line in course number 1. When the next course is knitted in accordance with the stitch diagram shown in line 2, the yarn is knitted only on the rear needles and then only on the alternate needles which were not knitted upon in course number 1. The yarn knitted on the reverse needles in course 2 is of a different colour or type to the yarn of course 1. In course number 3 a similar structure to that of course number 1 is knitted, again using the same colour yarn as course 1, but in this case the knitting is displaced by one needle to the right. In course 4 the second colour yarn is again knitted on the rear needles only but in this case the yarn is knitted upon the needles which were not knitted upon in course 2. This is a so called four-course repeat structure, which will produce a birds-eye-backed fabric. In such a fabric the technical reverse side of the fabric will comprise small squares or chequers of one colour in a matrix of another colour. The technical face will only have the appearance of the yarn which is knitted on courses and 3. It can be seen therefore that the front face of the fabric will have a different appearance to the reverse face.

The four pattern repeat may then be knitted as many times as is required and in the example is shown being repeated for 10 sets of 4 courses i.e. 40 courses in all.

In order that the reference number may be knitted into the fabric a different structure is then knitted.

Referring to course number 5, it can be seen that in the central region between the lines A and B the needles on the rear bed, corresponding to the technical reverse side of the fabric are not knitted upon at all. To the left of line A and to the right of line B alternate needles are knitted as in course 1. On the technical face side, being produced on the front needle bed, a continuous row of stitches is produced in exactly the way as was produced on the face side in course 1.

When the next course is knitted as shown in course 6, again there is no knitting of the second coloured yarn on the front face needles which are clearly shown as being all empty. Between the lines A and B the second coloured yarn is knitted on all of the needles, and on the portion of the fabric to the left of line A and to the right of line B alternate needles are knitted upon, as in course 2.

Course 7 corresponds to course 5, but displaced by one needle to the right or left. Course 8 corresponds to course 6 again displaced by one needle to the right or left.

It will be appreciated, therefore, when comparing courses 5,6,7 and 8 that only the yarn of coloured number 2 is knitted on the technical reverse face of the fabric and thus within the regions between lines A and B only yarn colour 2 appears between those lines, whereas the mixture of yarn colours 1 and 2 appears on the reverse face in regions produced by the repetition of courses 1 to 4.

However, on the face of the fabric in the regions between lines A and B which has been produced in accordance with the repetition of courses 5 to 8, the same colour of the yarn appears on the face as appeared in courses 1,3,5 and 7. The coloured yarn which is knitting courses 2,4,6 and 8 does not appear on the technical face of the fabric. Thus the technical face within lines A and B on courses 5 to 8 will be the same as that on either side of lines A and B and will be the same as the fabric knitted on courses 1 to 4. Thus the technical face of the fabric will continue to be a single colour whereas on the reverse the portion within lines A and B will show up clearly by contrast with the portions on either side and surrounding lines A and B.

Courses 9 to 12 are merely a complete repeat of courses 1 to 4. Again a further birds-eye-backed fabric is produced in which the yarn knitting on courses 9 and 11 is of the same colour as that knitted on courses 1,3,5 and 7. A different colour yarn is knitted on courses 10 and 12 which is the same colour as that knitted on courses 2,4,6 and 8.

In terms of the yarn colour, a completely different colour may be used i.e. blue and red. Alternatively contrasting shades of the same colour may be used, or a noncoloured yarn such as black, white or grey may be used.

Further, alternatively it is possible to use alternative types of yarn of the same colour having different appearances or textures.

It will be seen that by the provision of the present invention fabric markings can be provided on the rear of the double jersey fabric which cannot be readily seen on the fabric face. It will be appreciated that an expert in knitting may be able to determine the presence of the fabric marking on the reverse side by the nature of the stitches which appear on the face. However to the unskilled normal user of upholstered structures the marking on the reverse side is effectively invisible.

The invisible markings are most preferably produced on machines having a gauge between 10 gauge and 18 gauge and having a stitch density of between 20 and 40 courses to the inch, preferably 26 to 36 courses to the inch. Preferably the material is knitted from yarn having a yarn count during the knitting stage in the region of 500 to 800 decitex, preferably 650 to 750 decitex. By using a relatively tight fabric "grinning" (showing through) of the technical reverse of the fabric through the technical face is less likely to occur. The tighter stitch density also means that the markings may be more readily discernible.

It will be appreciated that any form of marking such as writing, pictures or any other suitable marks can be produced. The simple number shown in FIGS. 3 and 4 is by way of explanation only.

What is claimed is:

1. An upholstered structure comprising a three dimensional support core having a fabric cover, said fabric cover being double jersey knitted structure having a technical reverse side in contact with the support core and a technical face side on the outside, remote from the core, wherein the technical face side is formed of integral interconnected loops of yarn and the technical reverse side is formed of integral interconnected loops of yarn, the two sides being interconnected over substantial regions of the fabric by yarn loops integrally formed and passing between the technical face and technical reverse wherein on the technical reverse side there is integrally knitted during manufacture of the fabric at least one identifying mark in a contrasting yarn to its surroundings, the mark being substantially not visible on the technical face of the fabric.

2. An upholstered structure as claimed in claim 1 in which there are between 7.8 and 16 courses per cm, and the fabric has been knitted on a machine having a gauge between 10 gauge and 18 gauge.

3. An upholstered structure as claimed in claim 2 in which the yarn has a yarn count in the range 500 to 800 decitex.

4. An upholstered structure as claimed in claim 3 in which the yarn is an air textured polyester yarn.

5. A method of knitting a fabric cover for an upholstered structure, in which the knitting is carried out on an electronically controlled jacquard knitting machine having a pair of opposed needle beds and in which there is knitted a double jersey fabric having a technical reverse side for location on a core of the upholstered structure and a technical face side for the outside of the structure wherein the technical face side is formed of integral interconnected loops of yarn and the technical reverse side is formed of interconnected loops of yarn the two sides being interconnected over substantial regions of the fabric by yarn loops integrally formed and passing between the technical face and technical reverse side, wherein the fabric is integrally knitted with at least one identifying mark in a contrasting yarn to its surroundings, the mark being visible on the technical reverse of the fabric but being substantially invisible on the technical face of the fabric.

6. A method as claimed in claim 5 in which a plurality of fabric covers are knitted, and in which the mark identifies each individual cover or set of covers.

7. A method as claimed in claim 6 in which the jacquard is controlled to sequentially index the covers as they are knitted.

8. A method as claimed in claim 5 in which the fabric is a birds eye backed fabric.

9. A method as claimed in claim 6 in which the fabric is a birds eye backed fabric.

10. A method as claimed in claim 7 in which the fabric is a birds eye backed fabric.

11. A method as claimed in claim 5 in which the fabric is knitted on a 10 to 18 gauge knitting machine at a stitch density of between 7.8 and 16 courses per cm.

12. A method as claimed in claim 11 in which the yarn 30 has a yarn count in the range 500 to 800 decitex.

13. A method as claimed in claim 12 in which the yarn is an air textured polyester yarn.

* * * * *

UNITED STATES PATENT AND TRADEMARK OFFICE

CERTIFICATE OF CORRECTION

PATENT NO. : 5,213,863

DATED : May 25, 1993

INVENTOR(S) : Day et al.

It is certified that error appears in the above-indentified patent and that said Letters Patent is hereby corrected as shown below:

| | | |
|---|---|---|
| Col. 4, | line 2, | change "numeral i" to --numeral 1--. |
| Col. 4, | line 49, | after "courses", insert --1--. |

Signed and Sealed this

Eighth Day of March, 1994

Bruce Lehman

*Attest:*

BRUCE LEHMAN

*Attesting Officer*

*Commissioner of Patents and Trademarks*